US005265883A

United States Patent [19]

Choo

[11] Patent Number: 5,265,883

[45] Date of Patent: Nov. 30, 1993

[54] PLAYING RACKET

[76] Inventor: Moon Sook Choo, 44-33, Dodang-Dong, Poochon, Rep. of Korea

[21] Appl. No.: 962,406

[22] Filed: Oct. 16, 1992

[51] Int. Cl.[5] ..... A63B 59/00

[52] U.S. Cl. ..... 273/318; 273/344; 273/DIG. 25

[58] Field of Search ..... 273/318, 344, 67 R, 273/345, 346, 347, DIG. 25

[56] References Cited

U.S. PATENT DOCUMENTS

| | | | |
|---|---|---|---|
| 2,167,775 | 8/1939 | Price | 273/344 |
| 3,032,345 | 5/1962 | Lemelson | 273/346 |
| 3,999,748 | 12/1976 | Clark | 273/346 |
| 4,360,206 | 11/1982 | Bian | 273/344 |
| 4,995,617 | 2/1991 | Lee | 273/346 |
| 5,080,374 | 1/1992 | Yu | 273/346 |
| 5,160,147 | 11/1992 | Ping | 273/346 |

*Primary Examiner*—William H. Grieb

*Attorney, Agent, or Firm*—Brumbaugh, Graves, Donohue & Raymond

[57] ABSTRACT

A playing racket for playing the game of hit and catch with a hard smooth ball has a handle and a round frame integrally formed together, and a round elastic board secured to the disk along its periphery with a circular supporting frame which interlocks with the round frame. A front side of the board has a multiplicity of suction cups projecting therefrom adapted to catch an impinging ball and the back side of the board is used to hit the ball.

5 Claims, 7 Drawing Sheets

PLAYING RACKET

FIELD OF THE INVENTION

The present invention relates to an article for sport and play, more specifically, to a racket for playing the game of catch and hit.

BACKGROUND OF THE INVENTION

The game of hit has been publicly played, both as a form of play and as part of a sport such as tennis and badminton, etc. As is well known, these games are played by tossing an object such as a ball or shuttle cock between two or more players with the aid of racket; and the players take pleasure simply by hitting a ball or shuttle cock.

On the other hand, the game of catch has also been played since antiquity, as part of a sport such as base ball; and, in more recent times, such enjoyable playing device as catch ball employing commonly known as Velcro ("Velcro" is a registered trademark of the Velcro Manufacturing Company) were developed to satisfy young children's desire for easy catch upon contact [see U.S. Pat. Nos. 3,032,345; 3,999,748; and 4,995,617].

However, these prior art articles for sport or play no longer satisfy the player's desire for more dynamic game, because of their tedious and monotonous playing mechanism; and have also been proven to be very boring, because they play a role only as either hitting or catching device.

Therefore, needs have continued to exist for the development of a more enjoyable playing article to satisfy both catch and hit functions, while preserving the merits of prior art articles.

SUMMARY OF THE INVENTION

Accordingly, the primary object of the present invention is to provide an article for sport and play combining the catch and hit function so that the game meets the player's desire for more dynamic and enjoyable sport or play.

The present invention is directed to an article for game, i.e., a playing racket for hitting or catching a ball which comprises:

a roundshape frame having an integral handle;

said frame surrounding an elastic disk a front side of which functions as adhesion element to catch a ball upon contact;

the back side of said disk serving to hit a ball upon striking, a supporting frame which interlock with said roundshape frame for securing the disk in the frame.

It is another object of the present invention to provide a novel game of catch and hit, employing said playing racket and ball.

BRIEF DESCRIPTION OF THE DRAWINGS

These and other objects and features of the present invention will become apparent from the following descriptions read in conjunction with the accompanying drawings, in which.

DETAILED DESCRIPTION OF THE INVENTION

In describing the article of the present invention, the term "front side" is employed to point out a direction of the catching side of the racket; and "backside" is employed to point out a direction of the hitting side.

Figure 1:
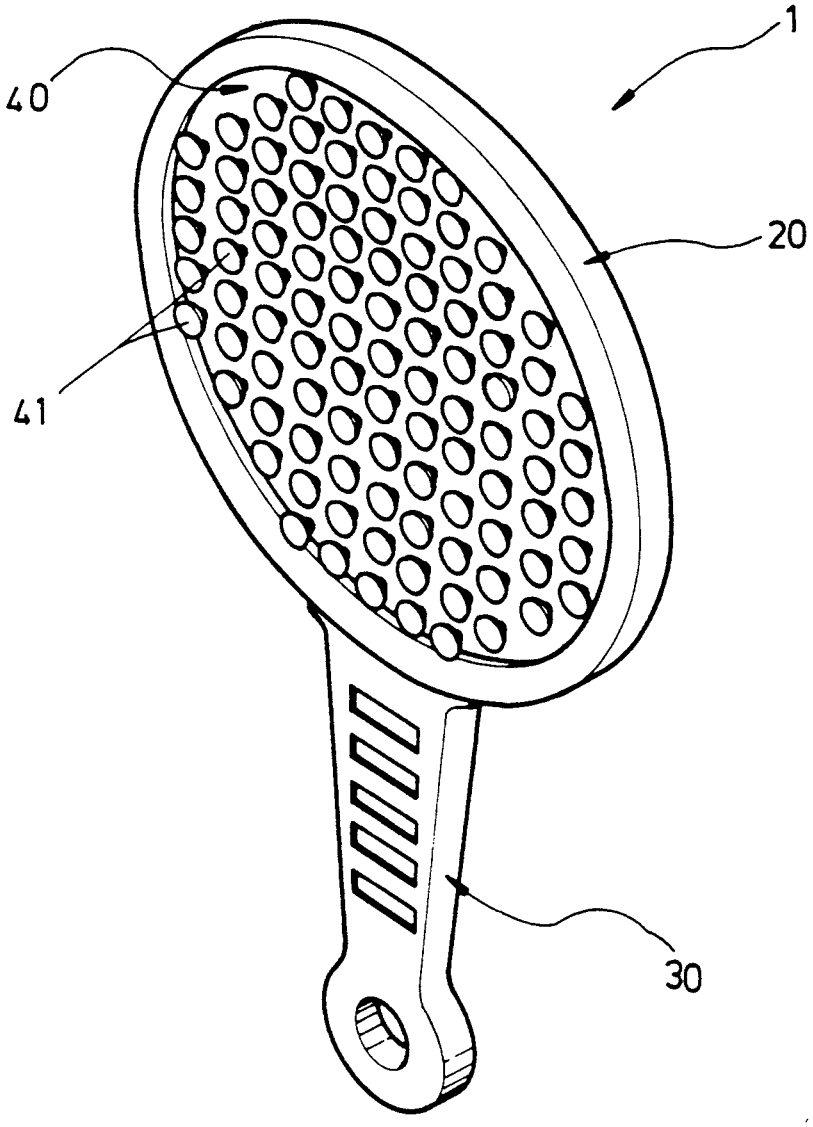
FIG. 1 is a perspective view of playing racket constructed according to the invention.

Referring to FIG. 1, there is shown a perspective view of the playing racket of the invention. As can be seen in FIG. 1, the racket (1) of the invention comprises two basic parts: a roundshaped frame part (20); and a handle part (30) which is integrally joined thereto at a point on the periphery of said frame.

Figure 2:
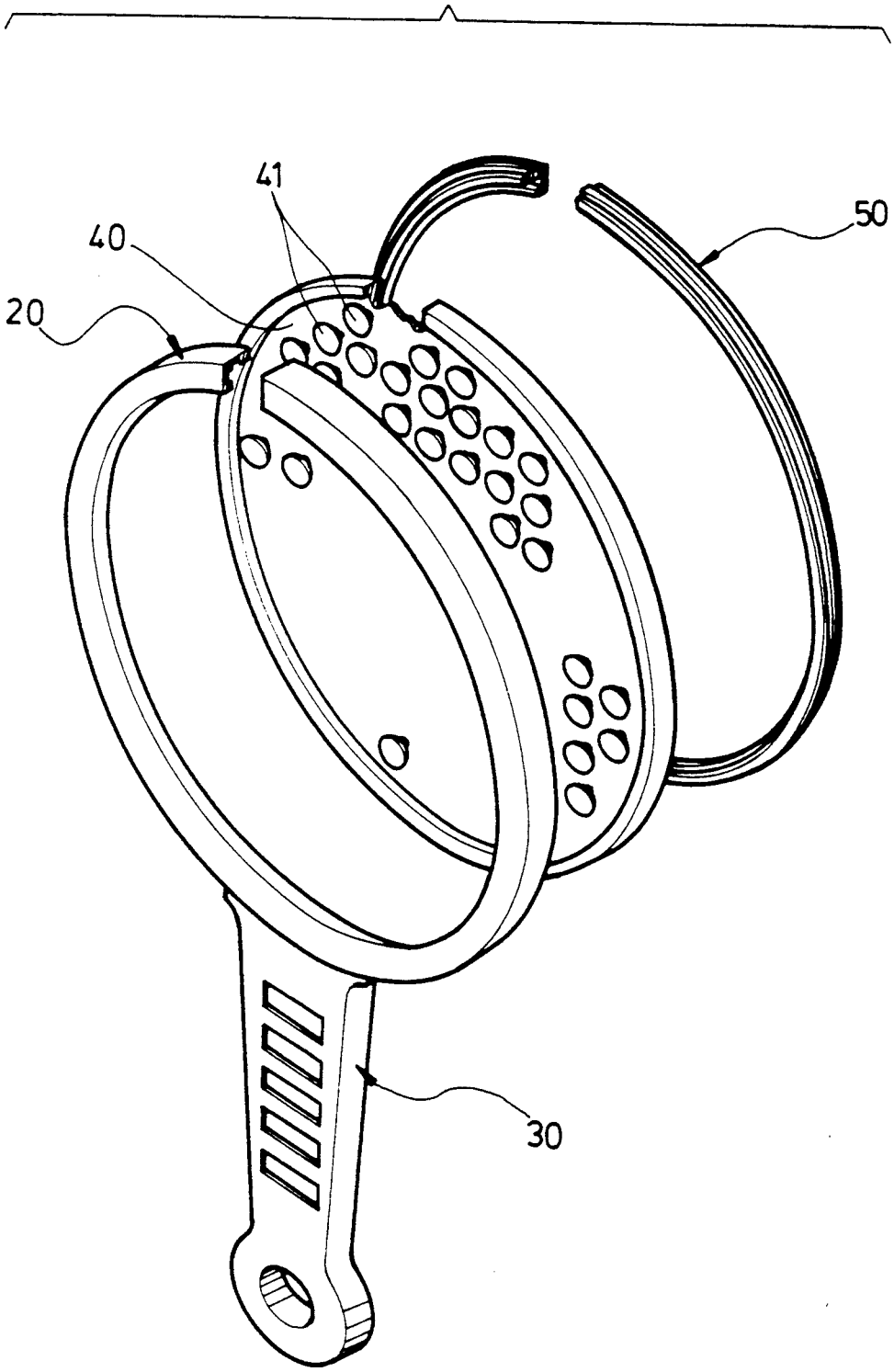
FIG. 2 is an exploded perspective view of the playing racket.

FIG. 2 is an exploded perspective view of the playing racket. As can be seen in FIG. 2, the playing racket also comprises: a disk (40) the front side of which has a multiplicity of flexible catching rubber suction cups (41) projecting therefrom; and a supporting frame (50) framed on the backside of said frame part (20) which encircles said disk (40), and thus prevents backward disintegration of the disk 40 when a ball impinges thereon.

In accordance with a feature of the invention, catching and holding of a ball is carried out based on the principle of vacuum adhesion between rubber suction cups and a ball; and preferred integration is designed to prevent disengagement between the ball and the suction cups. In this connection, the disk 40 and the projecting suction cups 41 are integrally molded from a material selected from the group including flexible and soft rubber-like materials to secure closeness between the ball and catching part; in this sense, natural rubber is preferably chosen to meet said requirements of rubber-like material, and a ball whose surface is relatively slick and hard, is also chosen to meet said closeness requirement.

Figure 3A:
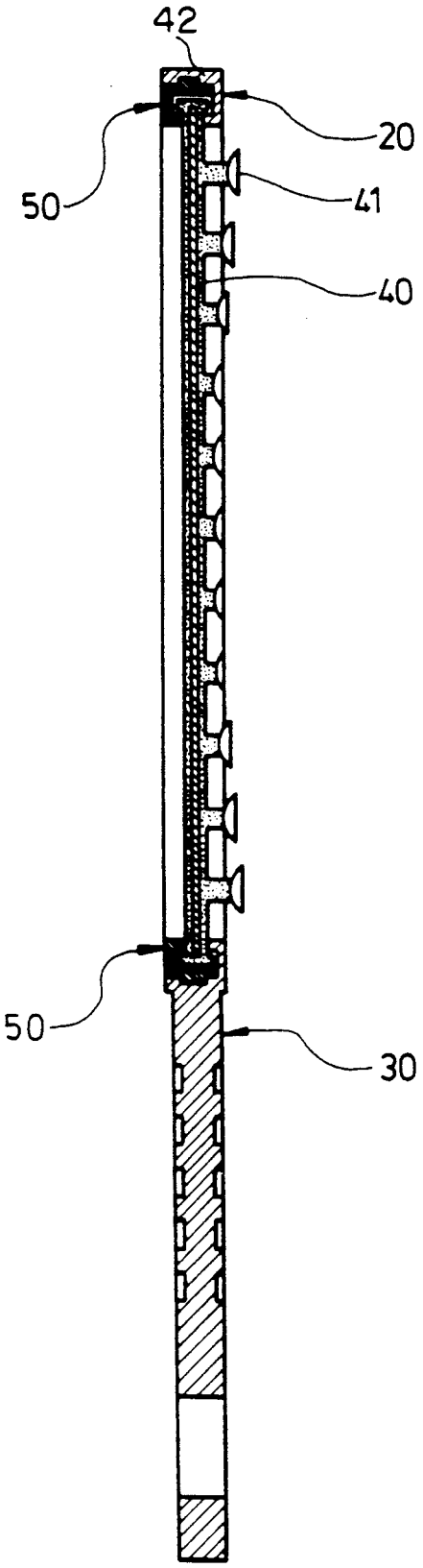
FIG. 3(A) and 3(B) are vertically sectional views of the playing racket.
Figure 3B:
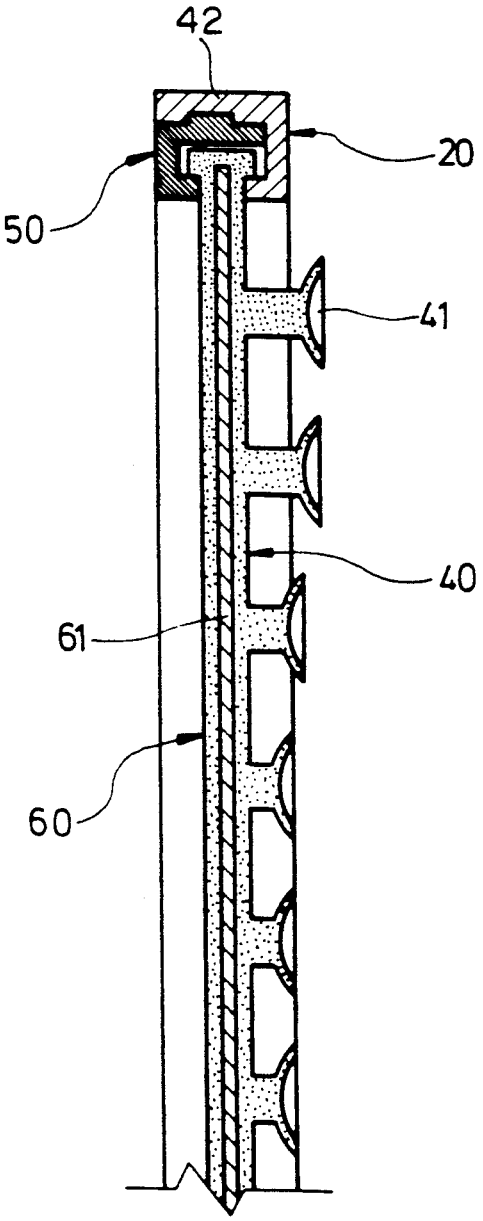

FIG. 3(A) is a longitudinally cross-sectioned view showing the structural integrity of the playing racket and FIG. 3(B) is an enlarged view of the core part of FIG. 3(A).

Figure 4:
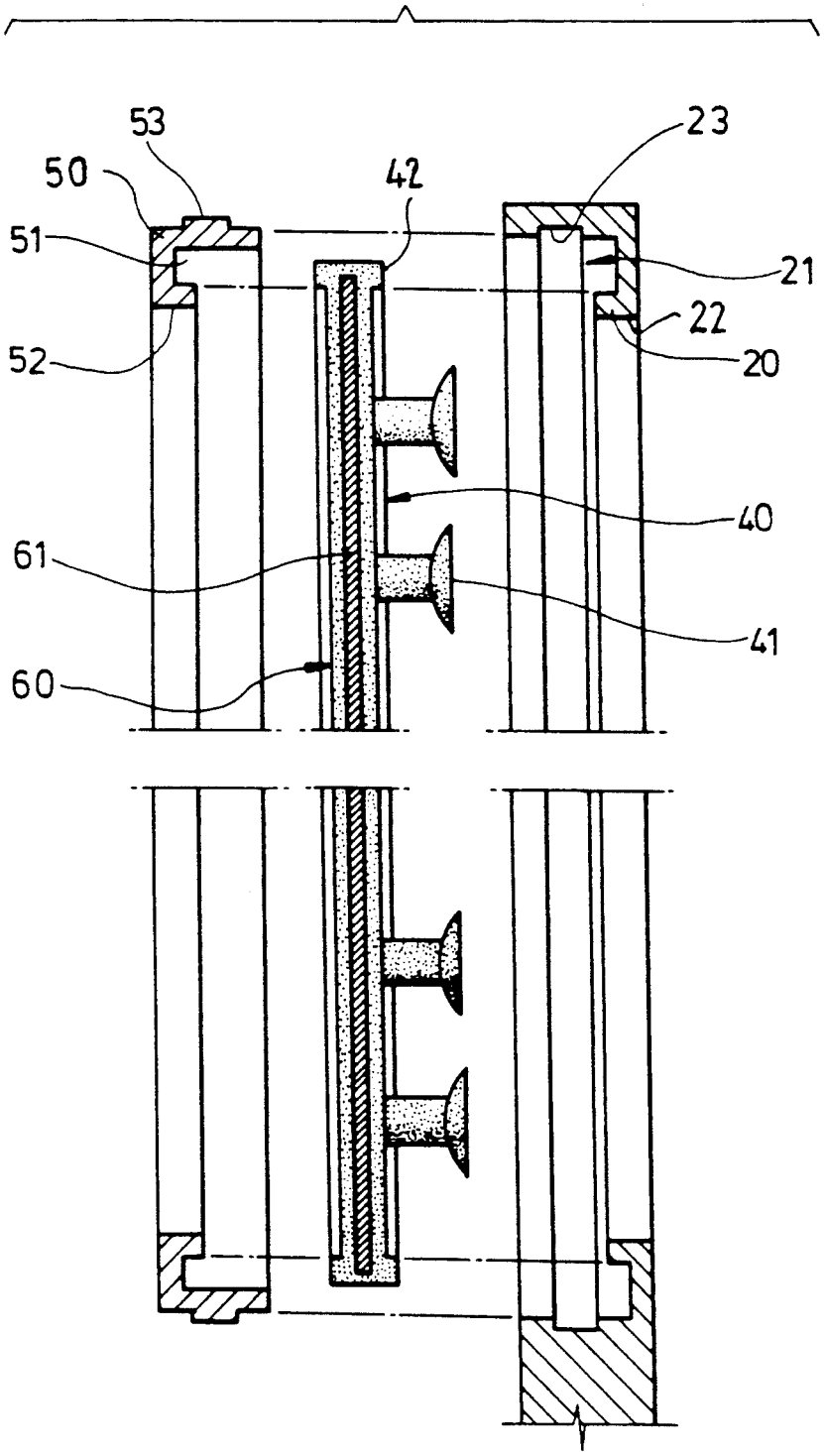
FIG. 4 is a cross-sectional view showing the structural integrity of the playing racket.

It will be seen from these figures and from FIG. 4 (which will presently be described in greater detail) that disk 40 has an integral sill 40 formed along its periphery which extends laterally from the front and back sides of the disk. The portion extending from the front side, that is, the side from which the suction cups 41 project, is received in an annular groove 21 formed in a confronting surface of the racket frame 20, and the portion extending from the back side is received in an annular groove 51 formed in the confronting surface of supporting frame 50, which is shaped and dimensioned to interlock with frame 20 thereby to secure the periphery of the disk 40 to the racket frame 20.

To better absorb the impact of a ball striking the catching side of the disk 40, the disk 40 may have a supporting board or plate 61 integrally molded therein; the material used for such supporting board, if provided, is preferably selected from the group comprising metallic plate and synthetic reins having outstanding rebound characteristics. The board 61 may be omitted if the elasticity of the material of which the disk is formed is such as to withstand any impact likely to be encountered when catching or hitting a ball.

FIG. 4 describes another cross-sectional view showing the structural integrity of playing racket in a more detailed manner. As can be seen in FIG. 4, the round-shape frame 20 consists of a receiving part 21 and a holding part 22 which hold the circumference of round-shaped disk (40) by fixing its portion bent backwards; and a holding groove(23) on which supporting frame(50) is fixed.

Supporting frame(50), under part of whose backside is bent to the direction of fore side to face said round-shape frame(20), comprises: a receiving part(51) and a holding part(52), which support the roundshape sill(42) of the catching part(40); and a fixing appendage(53) fixed on holding groove(23) of said roundshape frame(20). Accordingly, as a preferred manner of structural integration, said disk(40) is supported by positioning between said round frame(20) and supporting frame(50); and the manner of fixation may be the interlocking fixation illustrated in FIG. 3(B).

Figure 5:
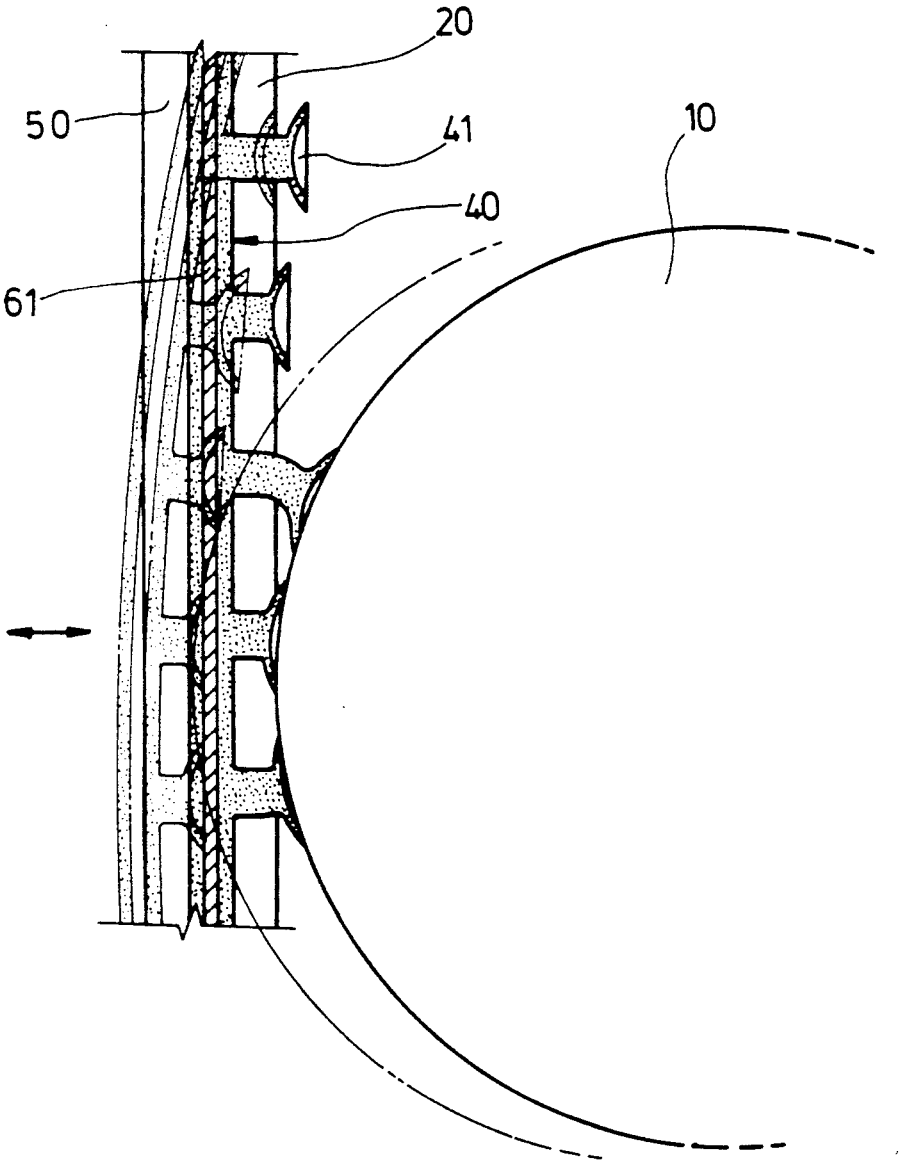
FIG. 5 is a cross-sectional view showing the feature of catching a ball upon contact.

FIG. 5 is a cross-sectional view showing the feature of catching a flying ball upon contact. As can be seen in FIG. 5, the suction cups 41 are close enough together that one or more of them are impinged by a ball 10 directed against the catching side of the racket, and upon impingement, to conform with and adhere to the surface of the ball and thereby catch the ball on the surface of catching side; that is, when the catching is aimed at the ball(10) in an analogous manner as hitting, the ball will consistently adhere to the surface of catching side(40) of the racket(1), grounded on the vacuum adhesion principle, thereby insuring a successful game of catch for player.

Figure 6:
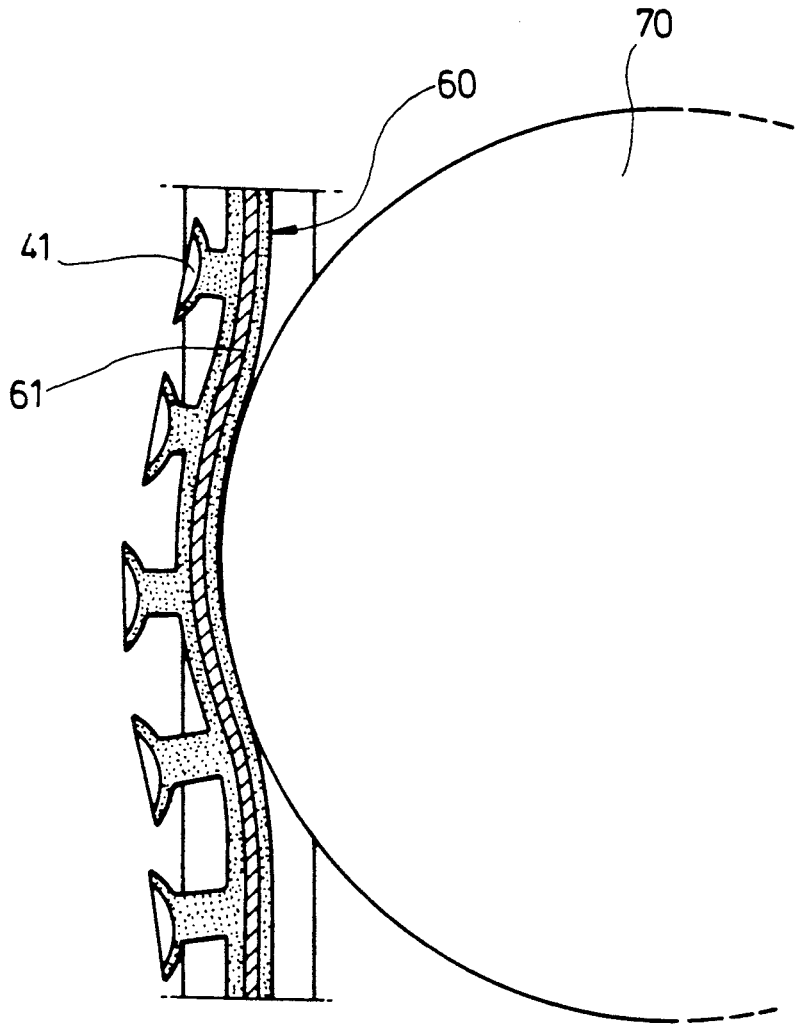
FIG. 6 is a cross-sectional view showing the feature of hitting a ball upon striking.

On the other hand, FIG. 6 depicts a cross-sectional view showing the feature of hitting a ball. As can be seen in FIG. 6, the players, with the aid of hitting part(60), can hit the ball in a similar manner as the above catching motion.

Figure 7A:
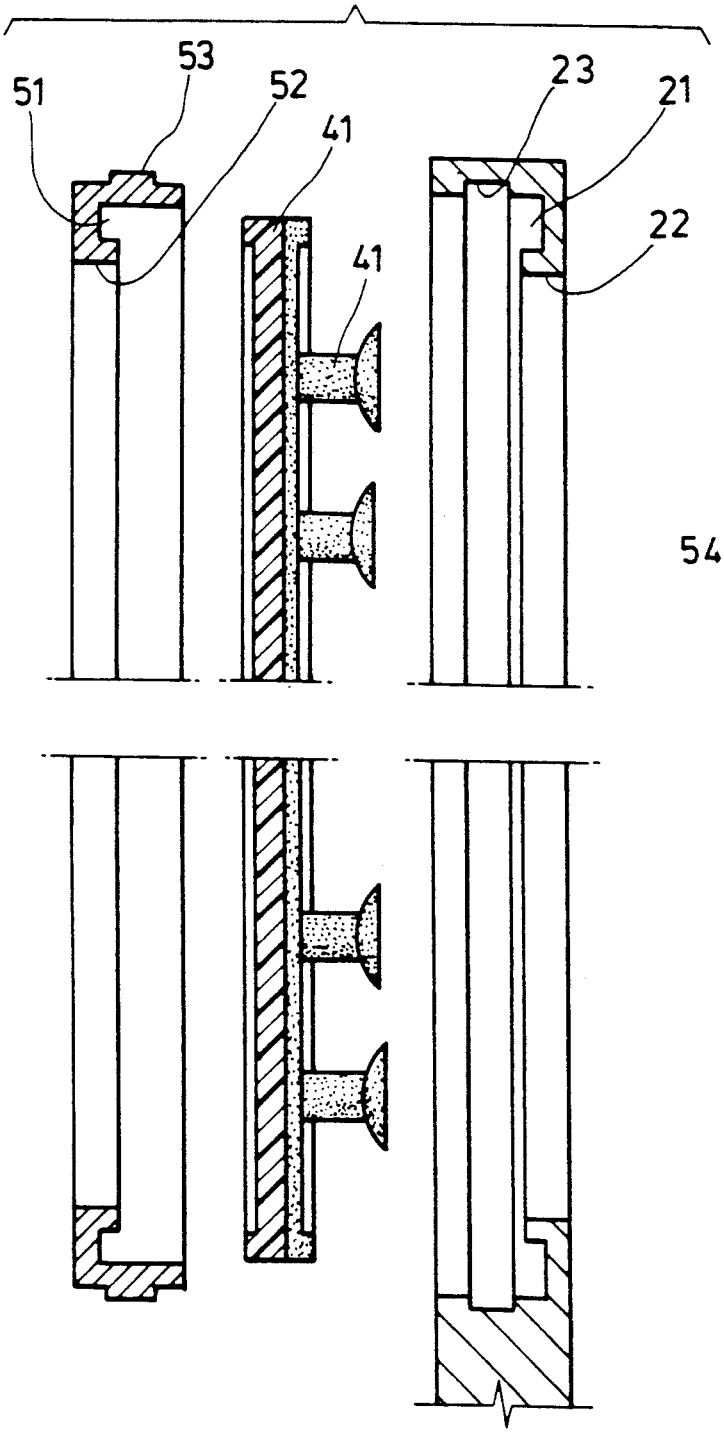
FIG. 7(A) is a cross-sectional view showing an alternative embodiment of the invention and FIG. 7(B) is a cross-sectional view showing an alternative embodiment of the supporting frame.

FIG. 7(A) is a cross-sectional view showing another embodiment of structural integration shown in FIG. 4. This embodiment is different from that of FIG. 4, in the manner of installing supporting board(61), i.e., while in the embodiment of FIG. 4 said supporting board is molded integrally, in the embodiment shown in FIG. 7(A) a separate supporting board is simply attached with catching/hitting board.

Figure 7B:
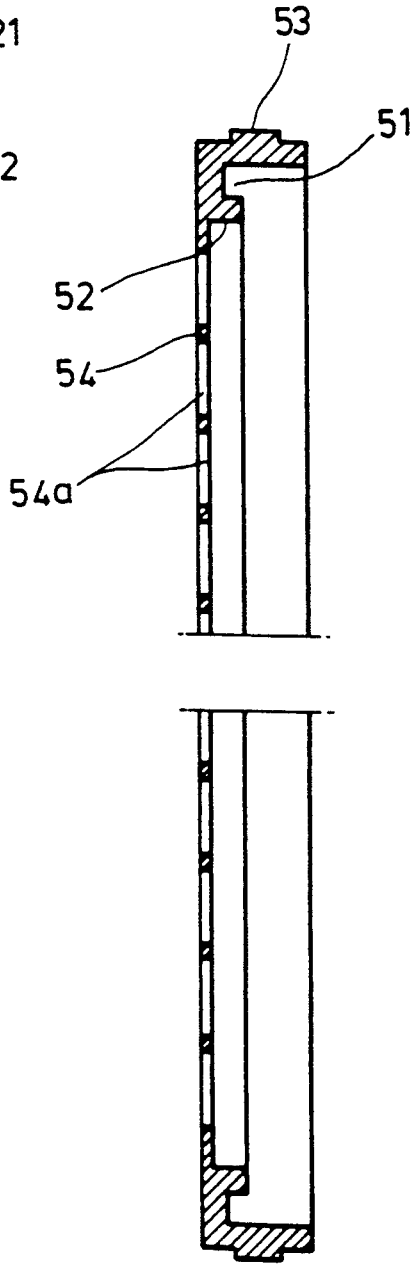

FIG. 7(B) is a cross-sectional view of another embodiment of the supporting frame(50). This embodiment is different from that of FIG. 7(A), in, that it employs a net or mesh-type hitting board(54) which is molded integrally with the supporting frame(50) and large holes(54*a*) are provided on in a regular manner, As illustrated in FIG. 7(B), the hitting board(54) is preferably separated from the backside of dish(40) so that the bounding efficacy would be maximized.

In accordance with said embodiment, a racket employing said mesh-type hitting board(54) can replace the common badminton racket for hitting a shuttle cock.

While the present invention has been shown and described with reference to the particular embodiments, it will be apparent to those skilled in the art that many changes and modifications in size, shape and materials, as well as in the details of illustrated structural integrations, may be made without departing from the spirit and scope of the invention as defined in the claims.

I claim:

1. A racket for playing the game of hit and catch with a hard smooth ball, said racket comprising;

a round frame having front and back sides and a handle portion integrally formed together, wherein said round frame has a groove formed in the back side thereof;

a circular board having front and back sides and having a sill which extends laterally in both directions from a peripheral edge thereof, said circular board having a multiplicity of integrally formed suction cups projecting from its front side arranged close enough that two or more will be impinged by a ball directed against said front side and upon impingement are adapted to conform with and adhere to the surface of the ball and thereby catch the ball on said front side, and having a flat surface on the back side for hitting a ball, said board including means for limiting the deflection of said board when hitting or catching a ball; and an annular supporting frame having an outer diameter corresponding to the outer diameter of the groove formed in the back side of said frame and having a slot formed therealong for receiving the sill on said board and engageable with the groove formed in said frame for retaining said board in place.

2. A racket according to claim 1 wherein said circular board and integral suction cups are formed of a soft, flexible rubber-like material, and wherein said means for limiting deflection comprises an elastic plate integrally molded within said circular board.

3. A racket according to claim 2, wherein said elastic plate is formed of metal.

4. A racket according to claim 2, wherein said elastic plate is formed of a synthetic resin material.

5. A racket according to claim 1, wherein the front side of said circular board comprises a front layer from which said integrally formed suction cups project, and said front layer is coupled to an elastic plate which defines the back side of said board and limits deflection of said front layer.

* * * * *

UNITED STATES PATENT AND TRADEMARK OFFICE

CERTIFICATE OF CORRECTION

PATENT NO. : 5,265,883

DATED : November 30, 1993

INVENTOR(S) : Moon Sook Choo

It is certified that error appears in the above-identified patent and that said Letters Patent is hereby corrected as shown below:

On the title page:

[30] Insert --Foreign Application Priority Data

August 6, 1992 [KR] Republic of Korea ..... 92-14696--;

Column 1, line 31, "needs have continued to exist" should read --a need exists--;

Column 1, line 39, "function" should read --functions--;

Column 1, line 51, "striking," should read --striking; and--;

Column 1, line 52, "interlock" should read --interlocks--;

Column 2, line 27, delete "catching";

Column 4, line 2, "dish" should read --disk--.

Signed and Sealed this

Twenty-fifth Day of October, 1994

Bruce Lehman

*Attest:*

BRUCE LEHMAN

*Attesting Officer*

*Commissioner of Patents and Trademarks*